US008011979B1

(12) United States Patent
Lai

(10) Patent No.: US 8,011,979 B1
(45) Date of Patent: Sep. 6, 2011

(54) TERMINAL STRIP

(75) Inventor: Ming-Chun Lai, Tu-Cheng (TW)

(73) Assignee: Cheung Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/832,977

(22) Filed: Jul. 8, 2010

(51) Int. Cl.
*H01R 11/22* (2006.01)

(52) U.S. Cl. ..... 439/855

(58) Field of Classification Search ..... 439/70, 439/83, 79, 885
See application file for complete search history.

(56) References Cited

U.S. PATENT DOCUMENTS 3,676,926 A * 7/1972 Kendall ..... 29/882
3,769,679 A * 11/1973 Kendall ..... 29/56.5
4,772,761 A * 9/1988 Ibrahim et al. ..... 174/541
4,926,548 A * 5/1990 Hopkins et al. ..... 29/860

* cited by examiner

*Primary Examiner* — T C Patel
*Assistant Examiner* — Phuongchi T Nguyen
(74) *Attorney, Agent, or Firm* — Cheng-Ju Chiang

(57) ABSTRACT

A terminal strip fixed to a plating machine has a main strip, a plurality of auxiliary strips extended from a side of the main strip, a plurality of terminals extended from a lateral side of the auxiliary strip. A free end of the terminal has an elastic arm extended opposite to the main strip, a free end of the elastic arm is extended beyond the auxiliary strip and forms a contacting portion. When the main strip is pulled for plating the contacting portions along a direction parallel with the main strip, it is feasible to try to avoid the other part of the elastic arm being plated, so as to save the gold and cut down the plating cost.

3 Claims, 2 Drawing Sheets

TERMINAL STRIP

BACKGROUND OF THE INVENTION

1. Field of the Invention

The present invention relates to a terminal strip, and particularly to a terminal strip capable of reducing the use of gold during plating.

2. The Related Art

FIG. 2 shows a conventional terminal strip 100'. The terminal strip 100' includes a connecting strip 20' and a plurality of terminals 10' extended from a side of the connecting strip 20'. The terminal 10' has a soldering slice 11' extended perpendicularly form a side of the strip 20'. A free end of the soldering slice 11' is extended perpendicularly to form a holding portion 12'. The holding portion 12' is extended forward to form an elastic arm 13' substantially paralleled with the connecting strip 20'. A free end of the elastic arm 13' is arched upwardly to form a contacting portion 14'. However, as the elastic arm 13' is parallel with the connecting strip 20', when the connecting strip 20' is pulled for plating the terminals 10', not only the contacting portion 14' but the whole elastic arm 13' may be plated. As a result, the gold consumption increases.

SUMMARY OF THE INVENTION

Accordingly, an object of the present invention is to provide a terminal strip fixed to a plating machine. The terminal strip has a main strip for being attached to the plating machine, at least one auxiliary strip extended from a side of the main strip, a plurality of terminals extended from a lateral side of the auxiliary strip. A free end of the terminal has an elastic arm extended opposite to the main strip, a free end of the elastic arm is extended beyond the auxiliary strip and forms a contacting portion which passes through a plating area along a direction parallel with the main strip for being plated by pulling of the main strip.

As described above, the auxiliary strip is extended from a front side of the main strip and connected with a plurality of terminals at a lateral side thereof. The elastic arm of the terminal extends beyond the auxiliary strip and is perpendicular to the main strip. As a result, when the main strip is pulled for plating the contacting portions of the terminals along a direction parallel with the main strip, it is feasible to try to avoid plating the other parts of the elastic arms, so as to save the gold and cut down the plating cost.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
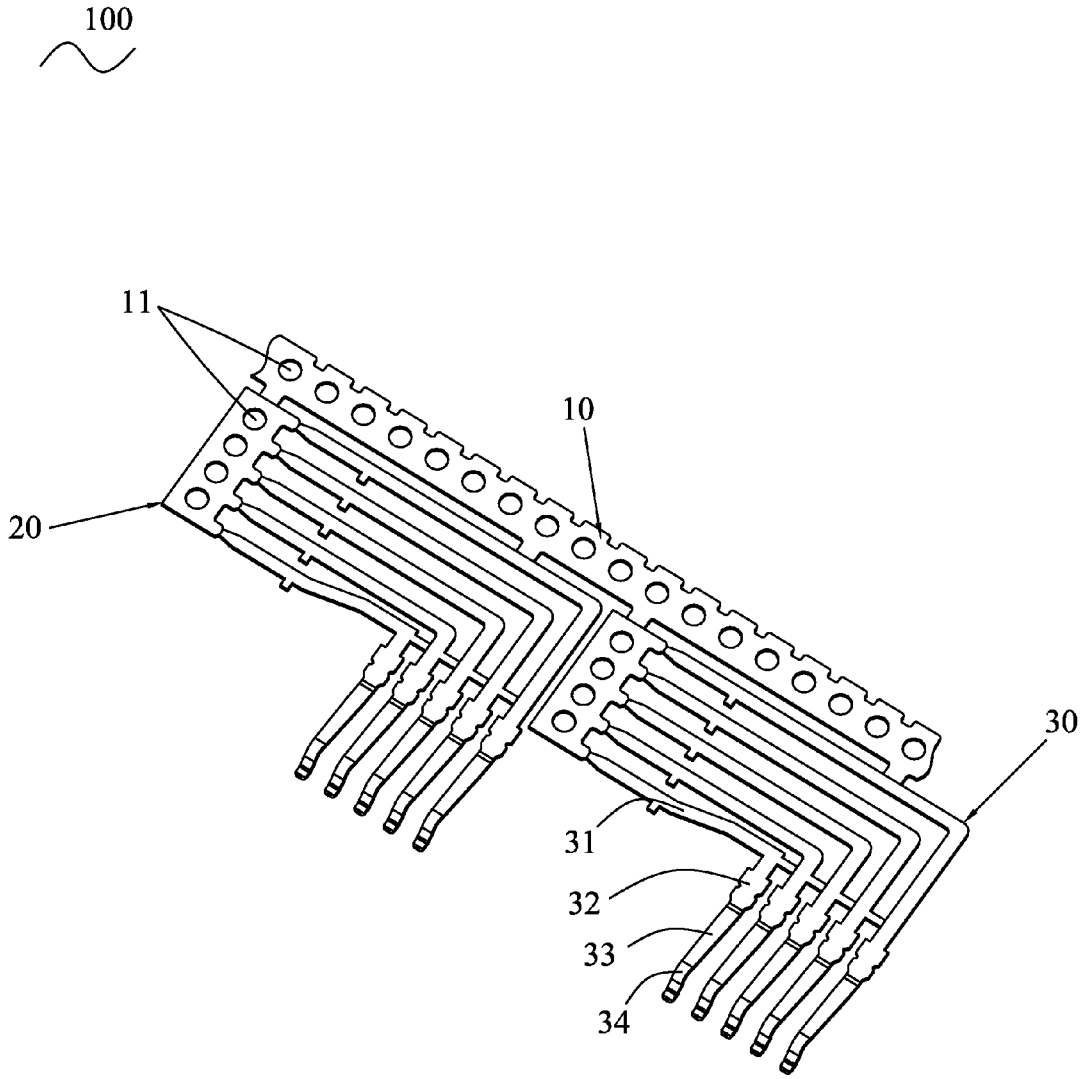
FIG. 1 is a perspective view of a terminal strip of an embodiment in accordance with the present invention.
Figure 2:
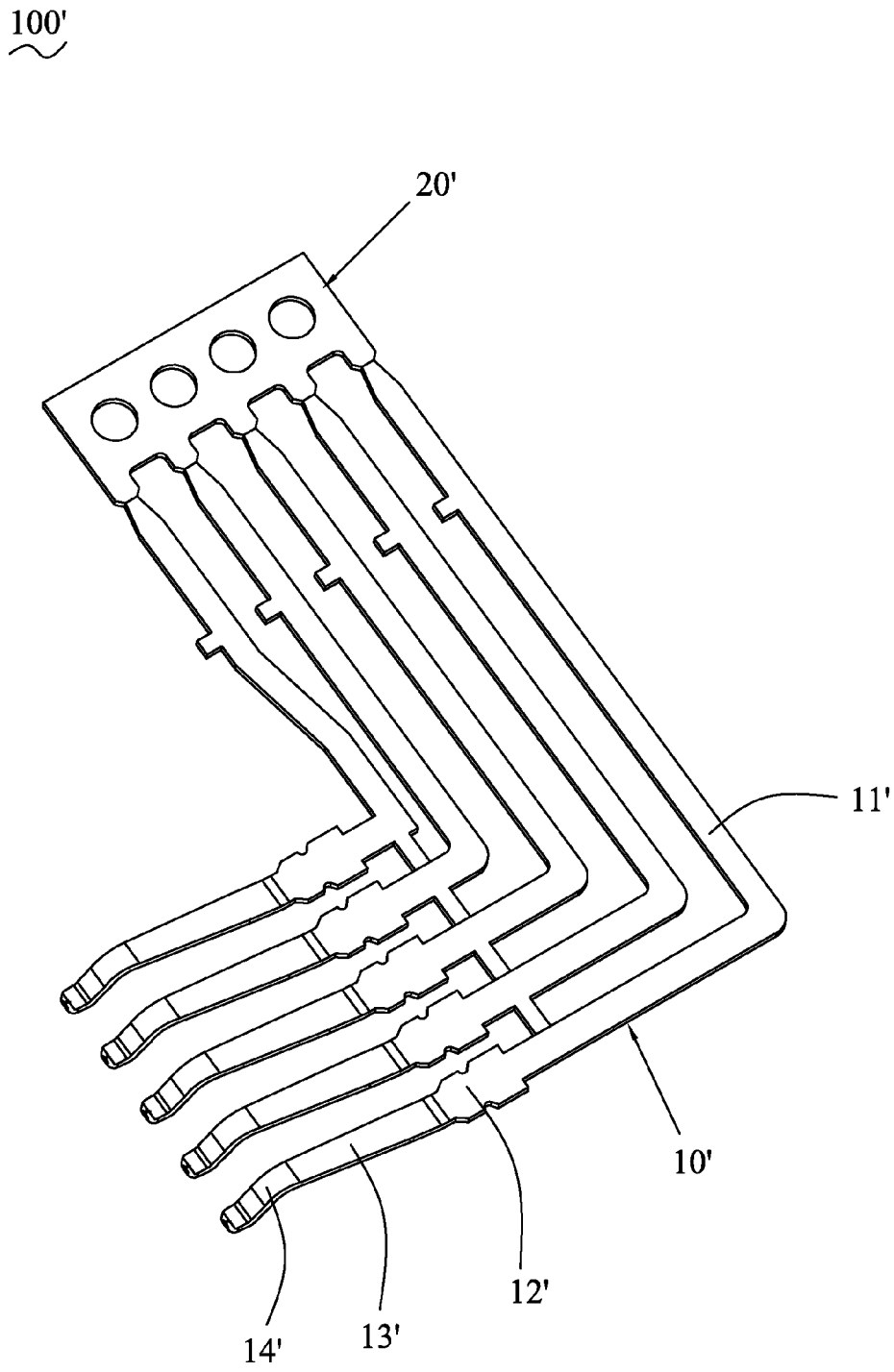
FIG. 2 (Prior Art)
FIG. 2 is a perspective view of a conventional terminal strip.

Please refer to FIG. 1, the embodiment of the invention is embodied in a terminal strip 100. The terminal strip 100 comprises a main strip 10, a plurality of spaced auxiliary strips 20 extended frontward from the main strip 10, a plurality of terminals 30 extended from the auxiliary strip 20.

The main strip 10 and the auxiliary strips 20 are punched to form holes 11 at intervals. A lateral side of the auxiliary strip 20 is extended to form a plurality of terminals 30 parallel with each other. Each of the terminals 20 has a soldering slice 31 of strip shape extending paralleled with the main strip 10. A free end of the soldering slice 31 is extended perpendicularly and opposite to the main strip 10 to form a rectangular holding portion 32. A free end of the holding portion 32 is extended frontward to form an elastic arm 33 perpendicular to the main strip 10. A free end of the elastic arm 33 is arched upwardly to form a contacting portion 34.

When the terminal strip 100 is plated, the main strip 10 is fixed on the plating machine for pulling the terminal strip 100 to have the contacting portion 34 going through a plating area along a direction parallel with the main strip 10.

As described above, a plurality of auxiliary strips 20 is extended from a front side of the main strip 10 and connects with a plurality of terminals 30 at a lateral side thereof. The elastic arm 33 is perpendicular to the main strip 10. As a result, when the main strip 10 is pulled for plating the contacting portions 34 along a direction parallel with the main strip 10, it is feasible to try to avoid the other part of the elastic arm 33 being plated, so as to save the gold and cut down the plating cost.

What is claimed is:

1. A terminal strip fixed to a plating machine, comprising: a main strip for being attached to the plating machine; at least one auxiliary strip extended from a side of the main strip; and a plurality of terminals extended from a lateral side of the auxiliary strip, a free end of the terminal having an elastic arm extended opposite to the main strip, a free end of the elastic arm beyond the auxiliary strip and forming a contacting portion which passes through a plating area along a direction parallel with the main strip for being plated by pulling of the main strip; wherein the main strip is punched to form holes at intervals for pulling the terminal strip while plating; wherein the terminal has a soldering slice extended from the lateral side of the auxiliary strip and parallel with the main strip, a free end of the soldering slice is bent perpendicularly and opposite to the main strip to form a holding portion, a free end of the holding portion is connected with the elastic arm.

2. The terminal strip as claimed in claim 1, wherein a free end of the elastic arm is arched upwardly to form a contacting portion.

3. The terminal strip as claimed in claim 1, wherein a plurality of auxiliary strips are extended from the main strip and spaced away from each other.

* * * * *